US010773740B2

(12) United States Patent
Carter

(10) Patent No.: US 10,773,740 B2
(45) Date of Patent: Sep. 15, 2020

(54) ONCOMING TRAIN ALARM ASSEMBLY

(71) Applicant: Dwayne Carter, St. Albans, NY (US)

(72) Inventor: Dwayne Carter, St. Albans, NY (US)

( * ) Notice: Subject to any disclaimer, the term of this patent is extended or adjusted under 35 U.S.C. 154(b) by 275 days.

(21) Appl. No.: 16/012,398

(22) Filed: Jun. 19, 2018

(65) Prior Publication Data

US 2019/0382041 A1 Dec. 19, 2019

(51) Int. Cl.

*B61L 23/06* (2006.01)
*B61L 25/02* (2006.01)
*B61L 13/00* (2006.01)

(52) U.S. Cl.

CPC ..... *B61L 23/06* (2013.01); *B61L 13/002* (2013.01); *B61L 25/02* (2013.01)

(58) Field of Classification Search

CPC ..... B61L 13/002; B61L 23/06; B61L 25/02; G08B 13/183

See application file for complete search history.

(56) References Cited

U.S. PATENT DOCUMENTS

D138,406 S 8/1944 Hadley
3,370,285 A * 2/1968 Cruse ..... G08B 13/184 340/556
4,010,459 A * 3/1977 Pontoppidan ..... G01S 13/56 340/533
4,118,691 A 10/1978 Sims
4,166,428 A 9/1979 Freeman
4,516,115 A * 5/1985 Frigon ..... G08B 13/183 340/556
5,128,548 A * 7/1992 Goodson ..... G01V 8/12 250/341.1
5,554,972 A * 9/1996 Byrne ..... G08B 13/183 250/221
5,727,758 A 3/1998 Penza
6,114,963 A * 9/2000 Blake ..... G08B 21/0202 340/521
6,471,162 B1 10/2002 Pace
7,624,952 B1 12/2009 Bartek
8,410,941 B2 * 4/2013 Kelly ..... E01B 17/00 116/22 A
10,148,760 B2 * 12/2018 Barragan ..... H04L 67/12
10,363,950 B2 * 7/2019 Worthey, Sr. ..... B61L 23/041
2007/0102591 A1 5/2007 Toth

FOREIGN PATENT DOCUMENTS

DE 2425642 A1 * 12/1975 ..... B61L 23/06
WO WO9725235 7/1997

* cited by examiner

*Primary Examiner* — Mark T Le

(57) ABSTRACT

An oncoming train alarm assembly for a railroad track includes a housing that defines an interior space. The housing is positioned on a first side of a railroad track. A power module and a microprocessor are coupled to the housing and positioned in the interior space. The microprocessor is operationally coupled to the power module. A transmitter and a speaker are coupled to the housing and operationally coupled to the microprocessor. The microprocessor is positioned to command the transmitter to transmit a photoelectric beam. A receiver is positioned on a second side of the railroad track. The receiver is operationally coupled to the microprocessor and aligned with the transmitter. The receiver is positioned to detect the photoelectric beam and to signal the microprocessor in event of a blocking of the photoelectric beam, positioning the microprocessor to actuate the speaker to sound an alarm to warn persons of an oncoming train.

20 Claims, 5 Drawing Sheets

ONCOMING TRAIN ALARM ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM.

Not Applicable

STATEMENT REGARDING PRIOR DISCLOSURES BY THE INVENTOR OR JOINT INVENTOR

Not Applicable

BACKGROUND OF THE INVENTION (1) Field of the Invention.

(2) Description of Related Art including information disclosed under 37 CFR 1.97 and 1.98.

The disclosure and prior art relates to alarm assemblies and more particularly pertains to a new alarm assembly for a railroad track.

BRIEF SUMMARY OF THE INVENTION

An embodiment of the disclosure meets the needs presented above by generally comprising a housing that defines an interior space. The housing is positioned on a first side of a railroad track. A power module and a microprocessor are coupled to the housing and positioned in the interior space. The microprocessor is operationally coupled to the power module. A transmitter and a speaker are coupled to the housing and operationally coupled to the microprocessor. The microprocessor is positioned to command the transmitter to transmit a photoelectric beam. A receiver is positioned on a second side of the railroad track. The receiver is operationally coupled to the microprocessor and aligned with the transmitter. The receiver is positioned to detect the photoelectric beam and to signal the microprocessor in event of a blocking of the photoelectric beam, positioning the microprocessor to actuate the speaker to sound an alarm to warn persons of an oncoming train.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
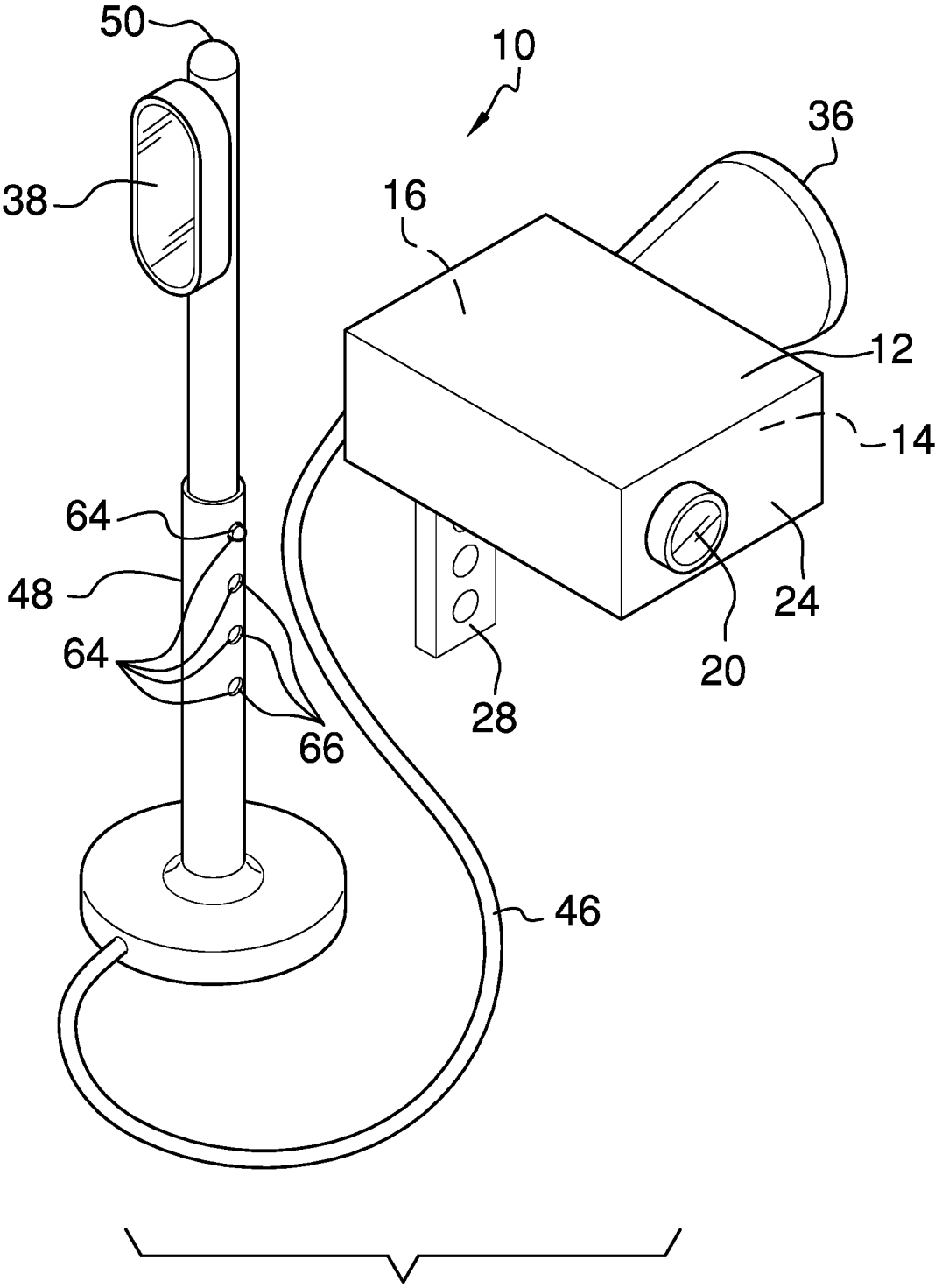
FIG. 1 is an isometric perspective view of an oncoming train alarm assembly according to an embodiment of the disclosure.

With reference now to the drawings, and in particular to FIGS. 1 through 6 thereof, a new alarm assembly embodying the principles and concepts of an embodiment of the disclosure and generally designated by the reference numeral 10 will be described.

As best illustrated in FIGS. 1 through 6, the oncoming train alarm assembly 10 generally comprises a housing 12 that defines an interior space 14. The housing 12 is substantially rectangularly box shaped. The housing 12 is positioned on a first side of a railroad track.

A power module 16 and a microprocessor 18 are coupled to the housing 12 and are positioned in the interior space 14. The microprocessor 18 is operationally coupled to the power module 16. A transmitter 20 and a speaker 22 are coupled to the housing 12. The transmitter 20 and the speaker 22 are operationally coupled to the microprocessor 18. The microprocessor 18 is positioned to command the transmitter 20 to transmit a photoelectric beam. The transmitter 20 emits visible light, infrared light, laser light, or the like. The transmitter 20 extends from a first end 24 of the housing 12. The speaker 22 is coupled to a side 26 of the housing 12.

Figure 2:
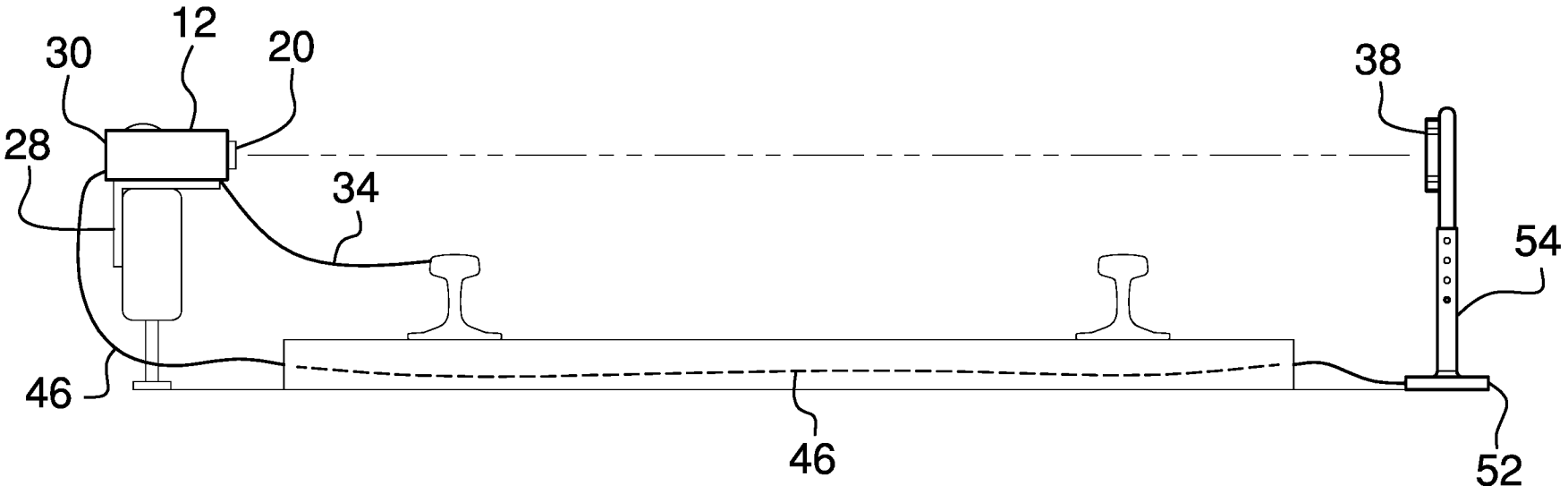
FIG. 2 is an in-use view of an embodiment of the disclosure.
Figure 3:
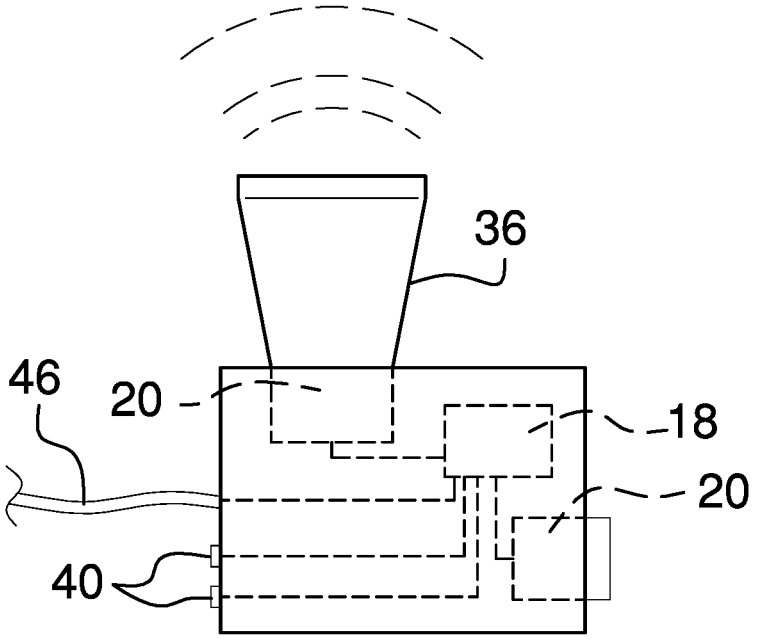
FIG. 3 is a top view of an embodiment of the disclosure.

The power module 16 comprises a third rail of the railroad track, as shown in FIG. 2. A bracket 28 is coupled to and extends from a second end 30 of the housing 12. A plurality of orifices 32 is positioned in the bracket 28. The orifices 32 are configured to receive mounting hardware to couple the housing 12 to the third rail so that the microprocessor 18 is operationally coupled to the third rail to power the microprocessor 18. A wire 34 is coupled to and extends between the housing 12 and the railroad track. The wire 34 is configured to ground the housing 12.

Figure 4:
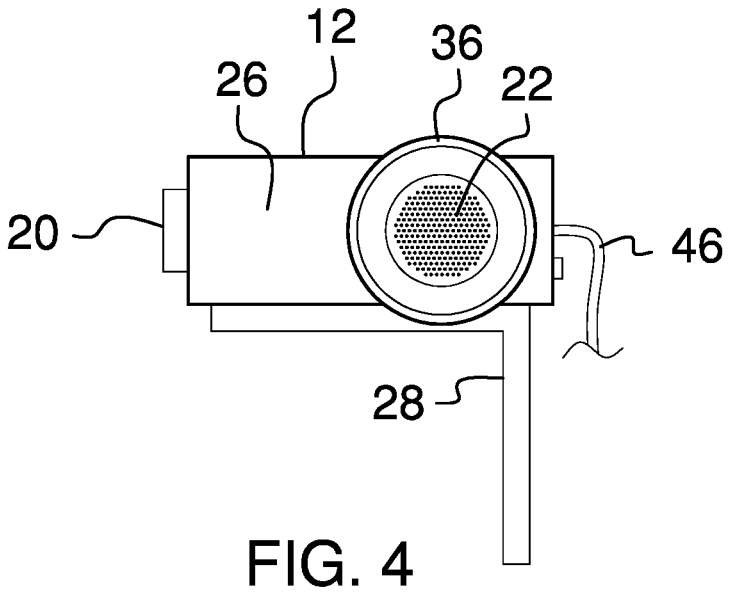
FIG. 4 is a side view of an embodiment of the disclosure.

A cone 36 is coupled to and extends from the housing 12, as shown in FIG. 4. The cone 36 is positioned around the speaker 22 and is configured to direct an alarm that emanates from the speaker 22.

A receiver 38 is positioned on a second side of the railroad track. The receiver 38 is operationally coupled to the microprocessor 18. The receiver 38 is aligned with the transmitter 20 so that the receiver 38 is positioned to detect the photoelectric beam and to signal the microprocessor 18 in event of a blocking of the photoelectric beam, as would occur when a train passes between the transmitter 20 and the receiver 38. In this event, the microprocessor 18 is positioned to actuate the speaker 22 to sound the alarm to warn persons of an oncoming train.

A controller 40 is coupled to the second end 30 of the housing 12. The controller 40 is operationally coupled to the microprocessor 18 and the power module 16. The controller 40 is positioned to selectively couple the microprocessor 18 to the power module 16 to power the microprocessor 18.

Figure 5:
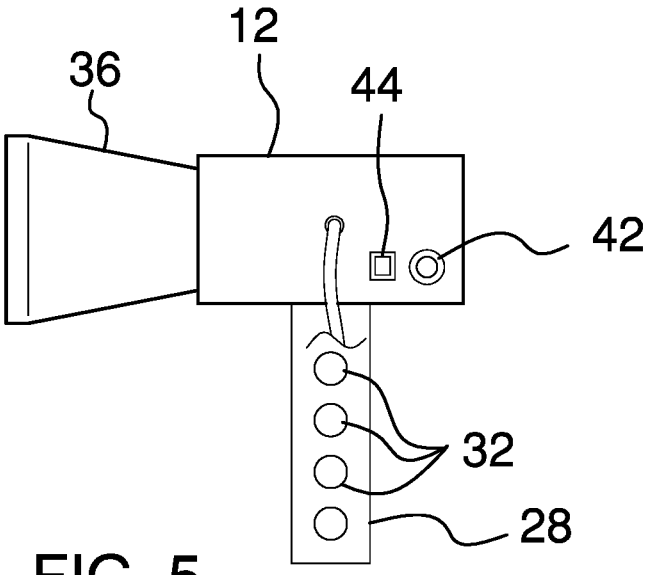
FIG. 5 is an end view of an embodiment of the disclosure.

The controller 40 comprises a first button 42 and a second button 44, as shown in FIG. 5. The first button 42 and the second button 44 are depressible. The first button 42 is configured to be depressed a first time to operationally couple the microprocessor 18 to the power module 16. The first button 42 is configured to be depressed a second time to decouple the microprocessor 18 from the power module 16. The second button 44 is configured to be depressed to signal the microprocessor 18 to reset after the alarm has been sounded by the speaker 22.

A cable 46 is coupled to and extends between the housing 12 and the receiver 38. The cable 46 is configured to supply power to the receiver 38 and to operationally couple the receiver 38 to the microprocessor 18. The cable 46 is positioned under the rails of the railroad track, as shown in FIG. 2.

A stand 48 is positioned on the second side of the railroad track, as shown in FIG. 2. The receiver 38 is coupled to the stand 48 proximate to a top 50 of the stand 48 so that the stand 48 positions the receiver 38 in alignment with the transmitter 20.

The stand 48 comprises a base 52 and a post 54. The base 52 is substantially circularly shaped. The post 54 is coupled to and extends perpendicularly from the base 52. The post 54 comprises a plurality of nested sections 56 so that the post 54 is selectively extensible. The post 54 is used to selectively position the receiver 38 to align with the transmitter 20.

Figure 6:
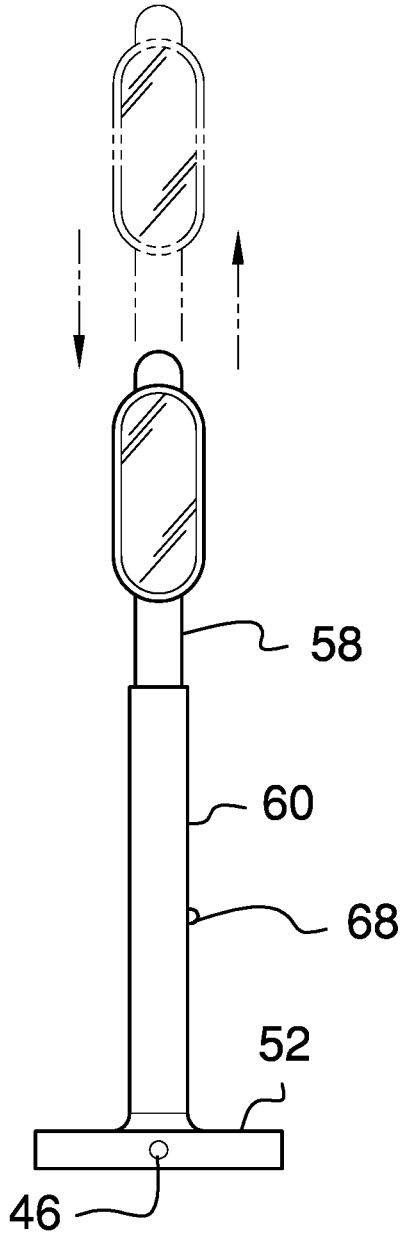
FIG. 6 is a detail view of an embodiment of the disclosure.

The plurality of nested sections 56 comprises an upper section 58 that is selectively extensible from a lower section 60, as shown in FIG. 6. A first coupler 62 is coupled to the lower section 60. A second coupler 64 is coupled to the upper section 58. The second coupler 64 is complementary to the first coupler 62. The second coupler 64 is positioned to selectively couple to the first coupler 62 to couple the upper section 58 to the lower section 60 to fixedly position the receiver 38 relative to the base 52.

The first coupler 62 comprises a plurality of holes 66. The second coupler 64 comprises a pin 68. The pin 68 is spring loaded. The pin 68 is configured to be depressed to adjust the upper section 58 relative to the lower section 60. The pin 68 is positioned to selectively insert into a respective hole 66 to couple the upper section 58 to the lower section 60 to fixedly position the receiver 38 relative to the base 52.

In use, the housing 12 is positioned on the first side of a railroad track and the stand 48 is positioned on the second side of the railroad track with the cable 46 extending under the rails of the railroad track. The housing 12 is coupled to the third rail. The receiver 38 that is coupled to the stand 48 is aligned with the transmitter 20 by adjusting the upper section 58 of the post 54 relative to the lower section 60 of the post 54. The receiver 38 is positioned to detect the photoelectric beam emitted by the transmitter 20 and to signal the microprocessor 18 in the event of the blocking of the photoelectric beam, positioning the microprocessor 18 to actuate the speaker 22 to sound the alarm to warn the persons of the oncoming train.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An oncoming train alarm assembly comprising:

a housing defining an interior space, said housing being positioned on a first side of a railroad track;

a power module coupled to said housing and positioned in said interior space;

a microprocessor coupled to said housing and positioned in said interior space, said microprocessor being operationally coupled to said power module;

a transmitter coupled to said housing, said transmitter being operationally coupled to said microprocessor wherein said microprocessor is positioned for commanding said transmitter for transmitting a photoelectric beam;

a speaker coupled to said housing, said speaker being operationally coupled to said microprocessor; and a receiver positioned on a second side of the railroad track, said receiver being operationally coupled to said microprocessor, said receiver being aligned with said transmitter wherein said receiver is positioned for detecting the photoelectric beam and signaling said microprocessor in event of blocking of the photoelectric beam positioning said microprocessor for actuating said speaker for sounding an alarm for warning persons of an oncoming train.

2. The assembly of claim 1, further including said housing being substantially rectangularly box shaped.

3. The assembly of claim 1, further including said transmitter extending from a first end of said housing.

4. The assembly of claim 1, further including said speaker being coupled to a side of said housing.

5. The assembly of claim 3, further comprising:

said power module comprising a third rail of the railroad track;

a bracket coupled to and extending from a second end of said housing;

a plurality of orifices positioned in said bracket wherein said orifices are configured for receiving mounting hardware for coupling said housing to the third rail such that said microprocessor is operationally coupled to the third rail for powering said microprocessor; and a wire coupled to and extending between said housing and the railroad track wherein said wire is configured for grounding said housing.

6. The assembly of claim 1, further including a cone coupled to and extending from said housing, said cone being positioned around said speaker wherein said cone is configured for directing the alarm emanating from said speaker.

7. The assembly of claim 3, further including a controller coupled to a second end of said housing, said controller being operationally coupled to said microprocessor and said power module wherein said controller is positioned for selectively coupling said microprocessor to said power module for powering said microprocessor.

8. The assembly of claim 7, further including said controller comprising a first button and a second button, said first button and said second button being depressible wherein said first button is configured for depressing a first time for operationally coupling said microprocessor to said power module and for depressing a second time for decoupling said microprocessor from said power module, wherein said second button is configured for depressing for signaling said microprocessor for resetting after the alarm has been sounded by said speaker.

9. The assembly of claim 1, further including a cable coupled to and extending between said housing and said receiver wherein said cable is configured for suppling power to said receiver and for operationally coupling said receiver to said microprocessor.

10. The assembly of claim 1, further including a stand positioned on the second side of the railroad track, said receiver being coupled to said stand proximate to a top of said stand wherein said stand is positioned for positioning said receiver in alignment with said transmitter.

11. The assembly of claim 10, further including said stand comprising:

a base; and a post coupled to and extending perpendicularly from said base, said post comprising a plurality of nested sections such that said post is selectively extensible wherein said post is positioned for selectively positioning said receiver for aligning with said transmitter.

12. The assembly of claim 11, further including said base being substantially circularly shaped.

13. The assembly of claim 11, further comprising:

said plurality of nested sections comprising an upper section selectively extensible from a lower section;

a first coupler coupled to said lower section; and a second coupler coupled to said upper section, said second coupler being complementary to said first coupler wherein said second coupler is positioned for selectively coupling to said first coupler for coupling said upper section to said lower section for fixedly positioning said receiver relative to said base.

14. The assembly of claim 13, further including said first coupler comprising a plurality of holes, said second coupler comprising a pin, said pin being spring loaded wherein said pin is configured for depressing for adjusting said upper section relative to said lower section and positioned for selectively inserting into a respective said hole for coupling said upper section to said lower section for fixedly positioning said receiver relative to said base.

15. The assembly of claim 1, further including said transmitter emitting visible light.

16. The assembly of claim 1, further including said transmitter emitting infrared light.

17. The assembly of claim 1, further including said transmitter emitting laser light.

18. An oncoming train alarm assembly comprising:

a housing defining an interior space, said housing being positioned on a first side of a railroad track, said housing being substantially rectangularly box shaped;

a power module coupled to said housing and positioned in said interior space, said power module comprising a third rail of the railroad track;

a microprocessor coupled to said housing and positioned in said interior space, said microprocessor being operationally coupled to said power module;

a transmitter coupled to said housing, said transmitter being operationally coupled to said microprocessor wherein said microprocessor is positioned for commanding said transmitter for transmitting a photoelectric beam, said transmitter emitting visible light, said transmitter extending from a first end of said housing;

a speaker coupled to said housing, said speaker being operationally coupled to said microprocessor, said speaker being coupled to a side of said housing;

a bracket coupled to and extending from a second end of said housing;

a plurality of orifices positioned in said bracket wherein said orifices are configured for receiving mounting hardware for coupling said housing to the third rail such that said microprocessor is operationally coupled to the third rail for powering said microprocessor;

a wire coupled to and extending between said housing and the railroad track wherein said wire is configured for grounding said housing;

a cone coupled to and extending from said housing, said cone being positioned around said speaker wherein said cone is configured for directing an alarm emanating from said speaker;

a receiver positioned on a second side of the railroad track, said receiver being operationally coupled to said microprocessor, said receiver being aligned with said transmitter wherein said receiver is positioned for detecting the photoelectric beam and signaling said microprocessor in event of blocking of the photoelectric beam positioning said microprocessor for actuating said speaker for sounding the alarm for warning persons of an oncoming train;

a controller coupled to said second end of said housing, said controller being operationally coupled to said microprocessor and said power module wherein said controller is positioned for selectively coupling said microprocessor to said power module for powering said microprocessor, said controller comprising a first button and a second button, said first button and said second button being depressible wherein said first button is configured for depressing a first time for operationally coupling said microprocessor to said power module and for depressing a second time for decoupling said microprocessor from said power module, wherein said second button is configured for depressing for signaling said microprocessor for resetting after the alarm has been sounded by said speaker;

a cable coupled to and extending between said housing and said receiver wherein said cable is configured for suppling power to said receiver and for operationally coupling said receiver to said microprocessor;

a stand positioned on the second side of the railroad track, said receiver being coupled to said stand proximate to a top of said stand wherein said stand is positioned for positioning said receiver in alignment with said transmitter, said stand comprising:

a base, said base being substantially circularly shaped, and a post coupled to and extending perpendicularly from said base, said post comprising a plurality of nested sections such that said post is selectively extensible wherein said post is positioned for selectively positioning said receiver for aligning with said transmitter, said plurality of nested sections comprising an upper section selectively extensible from a lower section;

a first coupler coupled to said lower section; and a second coupler coupled to said upper section, said second coupler being complementary to said first coupler wherein said second coupler is positioned for selectively coupling to said first coupler for coupling said upper section to said lower section for fixedly positioning said receiver relative to said base, said first coupler comprising a plurality of holes, said second coupler comprising a pin, said pin being spring loaded wherein said pin is configured for depressing for adjusting said upper section relative to said lower section and positioned for selectively inserting into a respective said hole for coupling said upper section to said lower section for fixedly positioning said receiver relative to said base.

19. The assembly of claim 18, further including said transmitter emitting infrared light.

20. The assembly of claim 18, further including said transmitter emitting laser light.

* * * * *